United States Patent [19]

Wagner

[11] 4,131,304

[45] Dec. 26, 1978

[54] AUTOMATIC STARTER FOR VEHICLE

[76] Inventor: Richard J. Wagner, 125 North Dr., Wyandotte, Mich. 48192

[21] Appl. No.: 795,288

[22] Filed: May 9, 1977

[51] Int. Cl.[2] ..... F02N 11/08

[52] U.S. Cl. ..... 290/38 C; 290/37 R; 123/179 B

[58] Field of Search ..... 290/38 C, 38 R, 37 R, 290/37 C, 38 D, 38 B, 38 A; 123/179 B, 179 R, 179 G, 179 BG

[56] References Cited

U.S. PATENT DOCUMENTS

| | | | |
|---|---|---|---|
| 2,975,296 | 3/1961 | Rego | 290/38 C |
| 3,562,542 | 2/1971 | Redmond | 290/38 C |

*Primary Examiner*—Herman Hohauser
*Attorney, Agent, or Firm*—Basile and Weintraub

[57] ABSTRACT

Automatic starters for an internal combustion engine and to a circuit for automatically starting the engine of an automotive vehicle at a predetermined time.

18 Claims, 3 Drawing Figures

AUTOMATIC STARTER FOR VEHICLE

BACKGROUND OF THE INVENTION

1. Field of the Invention

The invention relates to automatic starters for an internal combustion engine and, more particularly, to a circuit for automatically starting the engine at a predetermined time. More specifically the invention concerns an automatic starter for an automotive vehicle.

2. Prior Art

A variety of automatic systems for starting the engines at a predetermined time or from remote locations are well known. These systems provide the convenience of warming up the engine prior to the operator entering the vehicle so that it is ready to be driven immediately. This is particularly advantageous in the northern states during the winter where it takes a much longer time for the engine to warm up. Often the driver must sit in a cold automobile for a period of time even before he can move the vehicle, and then he must drive for several minutes before the engine warms up sufficiently to permit the heater to warm the interior. If the automobile can be automatically started a few minutes before the operator is ready, this inconvenience can be eliminated. A similar advantage is also available during the summer when the interior of the automobile becomes unbearably hot after sitting in the sun for any length of time. Under this condition, the capability of starting of the engine and turning on the air conditioner a short time before the operator enters the vehicle permits the interior to be cooled to a more tolerable temperature.

Automatic starting mechanisms range from the relatively simple system taught by Davis in U.S. Pat. No. 2,949,104 (August, 1960) which embodies a timer activating a relay through a vacuum switch. The vacuum switch terminates power to the starter relay when the engine starts and a vacuum is generated in the engines air intake manifold. This system provides no means for terminating power to the starter relay in event the engine fails to start which could eventually drain the battery. Ives in U.S. Pat. No. 3,151,249 (September, 1964) provides a mechanically actuated switch which terminates power to the starter relay after about 20 seconds to prevent draining the battery but is only capable of energizing the starter during the first 20 second interval. If the engine stops after this time, the circuit is incapable of restarting the engine. With this circuit it is possible within the 20 second interval to have a restart attempt before the engine stops from a prior start which could possibly damage the starter mechanism. Ives also teaches a throttle solenoid which advances the throttle to set the automatic choke facilitating starting of a cold engine. McWhirter in U.S. Pat. No. 3,259,753 (July, 1966) provides a stepper motor providing for a predetermined number of start attempts determined by the operator and a thermal switch to limit each start attempt to 10 seconds. After the predetermined number of start attempts, the stepper motor is deenergized terminating all subsequent start attempts. McWhirter teaches deenergizing the automatic starting system after the engine has started in response to the output from the generator. This method permits a restart attempt after a false start, (i.e. engine starts then dies as is common when starting a cold engine) and attempts a restart before the engine comes to a rest which could possibly damage the starting mechanism. In this system, the foot pedal is held in a fixed depressed position by a mechanical clamp and the automatic choke must be manually set by the operator. Fenner in U.S. Pat. No. 3,220,397 (November, 1965) teaches the use of a centrifugal switch in the starter relay circuit to prevent a restart attempt with the engine still turning after a false start. The Kennedy patent likewise teaches deactuating the automatic starting system in response to an output from the generator. This system has the disadvantage that the automatic choke and/or fast idle solenoid are not actuated until after the engine has started, which is the reverse of the normal operating procedure. Further, the thermal switch remains in the starter relay circuit even when the operator is attempting a manual start.

The disclosed automatic starting system overcomes the disadvantages of the prior art systems discussed above and closely follows the procedure followed by a human operator. It also provides an automatic shut down in event of a starter or engine failure and provides protection against a mechanical failure in the drive train of the vehicle.

SUMMARY OF THE INVENTION

The invention is an automatic system for energizing the starter of an internal combustion engine at a time determined by the operator.

A timer, at a preset time, a remote control or a thermally activated device energizes a relay circuit which initially applies electrical power to the engine ignition system and by means of a throttle solenoid, sets the engine's throttle to a start position. Then after a momentary delay applies electrical power to the engine's starter relay or solenoid energizing the starter motor to crank the engine. The electrical power is applied to the starter for a predetermined period, between 5 to 10 seconds. If the engine starts within the predetermined time, a vacuum switch in the engine's intake manifold de-energizes the throttle solenoid and starter motor and the engine is permitted to run for a predetermined period, which in the preferred embodiment, is about six to ten minutes. About three minutes after the relay circuit is energized, a second relay circuit energizes an accessory circuit which will turn on an accessory selected by the operator. This may be a heater or air conditioner of the vehicle powered by the engine. After the predetermined time the electrical power to the ignition system is terminated and the engine stops. This also deactivates the starter relay circuit preventing further actuation of the starter, and shuts off the selected accessory.

If the engine starts then stops, the starter relay circuit is reset, the starter relay circuit automatically resets the throttle solenoid, then sequentially applies electrical power to the starter relay initiating a second start attempt.

If the engine fails to start within the 5 to 10 seconds during which the starter motor is energized, a thermal timer de-energizes the starter relay circuit, preventing the starter motor from being energized by the automatic starting system and terminates the electrical power being supplied to the ignition system.

The object of the invention is an automatic starting system for starting an internal combustion engine at a time preset by the operator or when actuated by remote control or a thermal actuator closely following the starting procedure of a human operator.

Another object of the invention is an automatic starting system which energizes the ignition system and sets the throttle to a start position prior to energizing the starter motor.

Still another object is an automatic starting system which will automatically reset and make successive start attempts if the engine initially starts then stops.

Still another objective is an automatic system which will shut down automatically if the engine fails to start within a predetermined period.

A final objective is an automatic system which will turn on a selected accessory after the engine has warmed up for a predetermined period of time.

These and other objectives will become apparent from a reading of the following detailed description in conjunction with the drawings.

DETAILED DESCRIPTION OF THE PREFERRED EMBODIMENT

Figure 1:
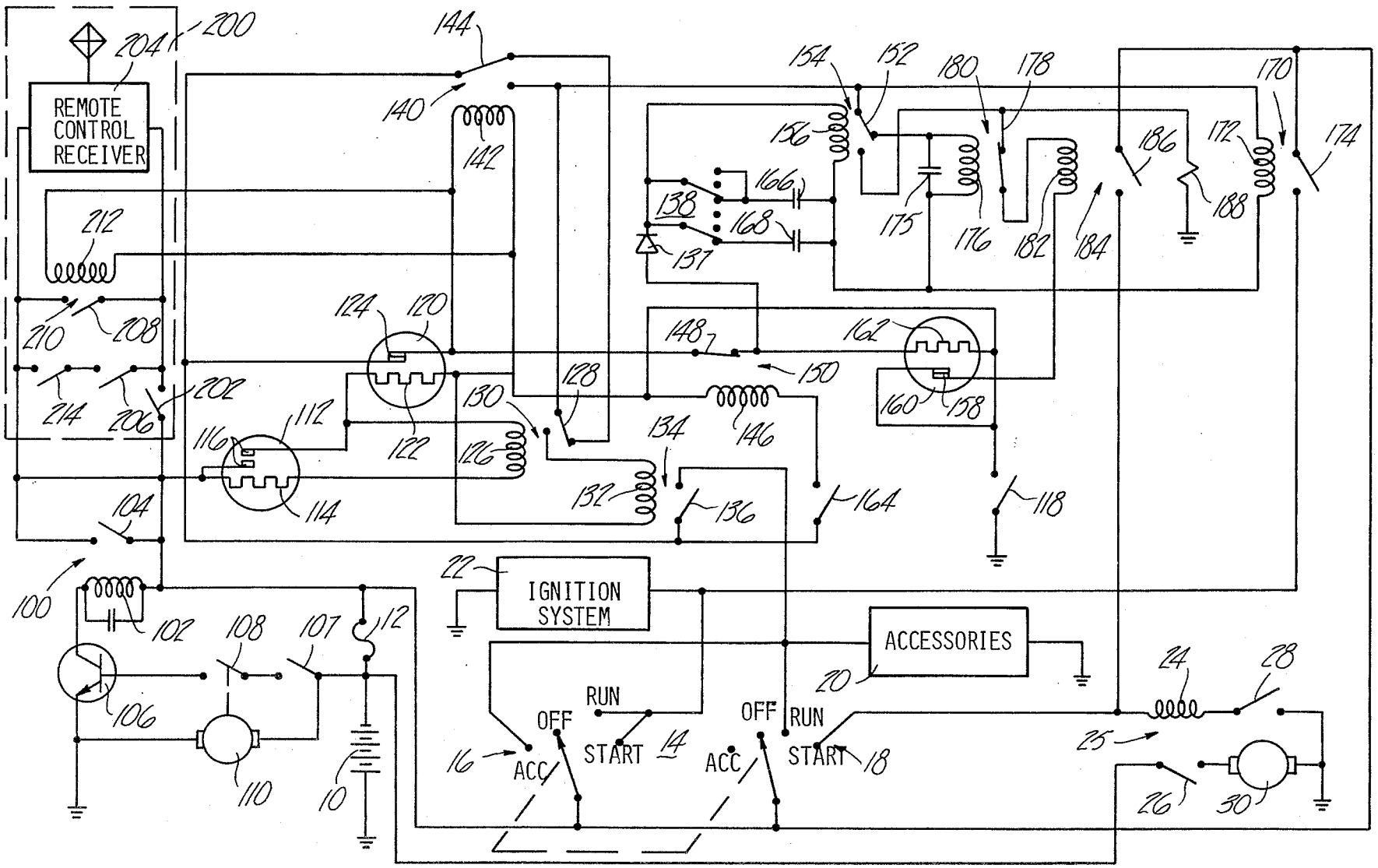
FIG. 1 is an electrical schematic of the preferred embodiment.

Referring to FIG. 1, there is shown a source of electrical power such as battery 10 having one terminal connected to a common ground and the other terminal connected to a fuse 12. The opposite end of the fuse 12 is connected to a conventional starter switch 14 comprising two ganged multiple contact switches, 16 and 18, respectfully. The starter switch 14 has four positions, the first position designated ACC supply electrical power to the accessories illustrated by block 20, on a OFF position, a RUN position to supply electrical power to the accessories 20 and a conventional spark ignition system illustrated by block 22, and a START position supplying electrical power to the ignition system 22 and to one end of the starter relay or starter solenoid coil 24. The other end of the starter relay or solenoid coil 24 is connected to the common ground through a gear shift interlock switch 28. Electrical power from battery 10 before fuse 12 is supplied to the starter motor 30 through the normally open starter switch 26. The operation of mechanically starting an engine using the ignition switch 14 is sufficiently well known that it need not be described in detail. It is sufficient to say, when the gear shift is in the PARK or NEUTRAL position, switch 28 is closed. The ignition switch 14 is subsequently placed in the START position, and electrical power is supplied to the ignition system 22 by switch 16 and starter coil 24 via switch 18 causing starter switch 26 to close providing electrical power to the starter motor 30.

The details of the automatic starting system will now be discussed. The automatic starting system comprises a first relay 100 having a relay coil 102 with one end connected to the battery 10 through fuse 12 and the other end connected to collector of transistor 106. The emitter of transistor 106 is connected to ground. Battery power is connected to the base of transistor 106 by means or a normally open switch 107 and clock switch 108 actuated by the clock, for example, an electronic clock, illustrated as a motor 110 connected between the fuse 12 and ground. Relay 100 has a normally open switch 104 connected between fuse 12 and one end of heater element 114 of thermal timer 112. The other end of the heater element 114 is connected to ground through a normally open interlock switch 118, such as a parking brake switch. Interlock switch 118 is closed when the interlock is in the actuated or ON position. The thermal timer 112 also has a normally open switch 116 which closes after a predetermined time. In the preferred embodiment, switch 116 closes in about one to three minutes after power is applied to the heater element 114. Switch 116 is connected between switch 104 and the heater element 122 of a second thermal timer 120. The other end of the heater element 122 is connected to ground through the interlock switch 118. A coil 126 of a second relay 130 is connected in parallel with heater 122 between normally open switch 116 and ground through interlock switch 118. The coil 126 actuates a single pole double throw switch 128. A coil 132 of a third relay 134 is connected between the normally open contact of switch 128 and ground through interlock switch 118. Coil 132 actuates a normally open switch 136, which is connected between fuse 12 and the accessories 20 as well as appropriate terminals of the ignition switch 14 as shown.

Referring back to thermal timer 120, the heater element 122 opens a normally closed switch 124 after a predetermined period of time, which in the preferred embodiment is three to five minutes. Switch 124 is connected between switch 104 and the coil 142 of relay 140 and switch 148 of relay 150. The opposite end of switch 148 is connected to the heater 162 of thermal timer 160 and the anode of diode 137. The opposite end of heater 162 is connected to ground through interlock switch 118. The cathode of diode 137 is connected to the pole terminals of a manually actuated double pole multiple position switch 138 and coil 156 of relay 154. Both contacts of one of the poles of switch 138 are connected to one electrode of capacitance 166 while only one contact of the other pole of switch 138 is connected to one electrode of capacitance 168. A third position is provided to which neither capacitance 166 or 168 are connected. The opposite electrodes of capacitances 166 and 168 are connected to the opposite end of coil 156 and to ground through the closed contacts 158 of thermal timer 160 and the interlock switch 118. Alternatively switch 138 may be a single pole multiple position switch and capacitances 166 and 168 may be of different values.

Referring back to relay 140, the normally closed contact is connected to the normally open contact through the normally closed contact of switch 128 in relay 130. The normally open contact of switch 144 is also connected to switch 128 of relay 130, switch 152 of relay 154, and coil 172 of relay 170.

Referring now to relay 154, the normally closed contact is connected to coil 176 of power relay 180. The opposite end of coil 176 is connected to ground through switches 158 and 118. The normally open contact of switch 152 is connected to switch 178 of relay 180 and throttle solenoid 188. When throttle solenoid 188 is actuated, it places the throttle in a start position. The opposite end of the throttle solenoid is connected directly to the common ground. The coil 182 of a second power relay 184 is connected between switch 178 and ground through switches 158 and 118. Coil 182 actuates switch 186 connected between fuse 12 and the starter relay or solenoid coil 24. Capacitance 175 is connected in parallel with coil 176 and provides for a momentarily continued energizing of coil 176 after coil 156 is energized actuating switch 152. This keeps switch 178 open momentarily delaying the application of electrical power to the starter relay or solenoid coil 24.

Referring back to relay 170, the opposite end of coil 172 is connected to ground through switches 158 and 118. Coil 172 actuates normally open switch 174 which is connected between fuse 12 and the ignition system 22.

Referring back to relay 150, the coil 146 has one end connected to a normally open vacuum switch 164 which responds to the pressure in the engines intake manifold. The opposite end of switch 164 is connected to switch 104. The opposite end of coil 146 is connected to ground through interlock switch 118. Activation of coil 146 opens switch 148 which effectively deactivates the starter relay or solenoid 24 and the throttle solenoid 188 after a time period selected by switch 138 thus preventing a start attempt when the engine is running.

It is to be understood that fuse 12 is symbolic, and different segments of the circuit may have separate fuses.

NORMAL OPERATION

Figure 2:
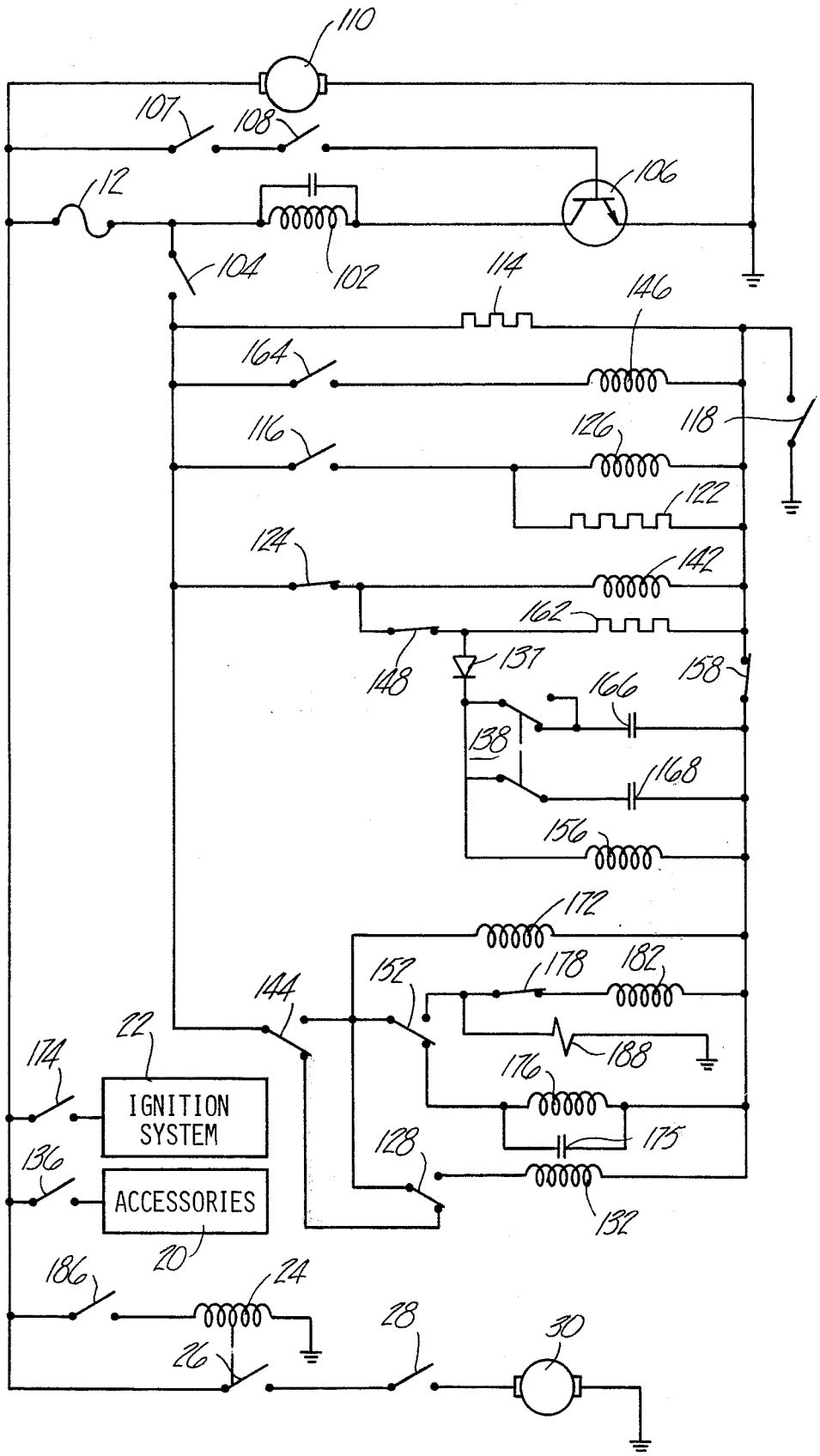
FIG. 2 is a simplified circuit schematic of a first embodiment shown in FIG. 1.

The operation of the automatic starter system will be explained with reference to FIG. 2. The circuit diagram illustrated in FIG. 2 is the same as that shown in FIG. 1 except that the locaton of the switches and coils in the individual relays and heaters and switches in the thermal elements are separated from each other resulting in a simpler schematic. Since they do not constitute a part of the invention, the manual ignition switch 14 and the associated circuitry have also been deleted from FIG. 2. For continuity, the identifying idicia of the individual elements in both circuit diagrams are the same.

It is assumed the vehicle is parked with the ignition in the OFF position and the gear shift lever in the PARK or NEUTRAL position.

The automatic starting system is set into operation by setting or putting the parking brake to its ON position closing interlock switch 118, closing switch 107 and presetting the timer 110 to the desired start time. Switch 107 may be a separate switch or may be integral with the clock setting mechanism. If it is desired that either the heater or air conditioning systems are to be automatically turned on also, these accessories are also turned ON. At the desired time, the timer 110 closes switch 108 biassing transistor 106 into conduction thereby energizing coil 102 and causing switch 104 to close. The closing of switch 104 applies battery power directly to switches 116, 124, 144 and 164 and heater 114. Meanwhile, coil 142 receives electrical power through normally closed switch 124 of thermal timer 120 and coil 156 receives electrical power through thermal time switch 124 normally closed switch 148 and diode 137. However, before switches 144 and 152 are actuated by the application of electrical power to their respective coils, capacitance 175 in parallel with coil 176 becomes fully charged. After switch 152 is actuated capacitance 175 discharges through actuating coil 176 keeping switch 178 open. Switch 178 remains open until capacitance 175 discharges thereby disabling coil 182 keeping switch 186 open and thereby delaying the actuation of the starter relay 24 for a predetermined of time.

When switch 144 is actuated, battery power is applied to coil 172 and to the poles of switches 152 and 128. Battery power is also applied to the heater 162 of thermal timer 160 through switches 124 and 148. Activation of coil 172 closes switch 174 applying battery power to the ignition system 22. The energizing of coil 156 actuates switch 152 applying battery power to the throttle solenoid 188 and switch 178 which is being held open by the discharge of capacitance 175 through coil 176. The throttle solenoid is actuated and the throttle is placed in a start position. In cold weather, actuation of the throttle solenoid 188 will, also, set the automatic choke and fast idle. After capacitance 175 discharges sufficiently, coil 176 is deenergized and switch 178 closes applying power to coil 182 closing switch 186. When switch 186 is closed, the starter relay coil 24 is energized closing switch 26 and electrical power is supplied to the starter motor 30. As soon as the engine starts, the pressure in the engines intake manifold decreases closing the vacuum switch 164 actuating coil 146 which opens switch 148. Opening of switch 148 deactivates coil 156 after the time period selected by switch 138. The switch 152 then returns to its unactivated position (as shown) deactivating throttle solenoid 188 and starter motor and activating coil 176 to open switch 178. The deenergizing of coil 156 is delayed by the action of capacitance 166 and 168, as selected by switch 138 which discharge through coil 156 after switch 148 opens. This delay extends the starting period for a short time after vacuum developes in the manifold to assure starting of the engine. After about one to three minutes, thermal timer switch 116 closes applying electrical power to the heater 122 and coil 126. Coil 126 actuates switch 128 applying electrical power to coil 132. Coil 132 actuates switch 136 applying electrical power to the accessories 20. This will turn on the heater, air conditioner or any other accessory preselected by the operator. Three to five minutes after power is applied to heater 122, switch 124 will open effectively terminating electrical power to the accessories 20 and the ignition system 22. With electrical power terminated to the ignition system, the engine will stop.

Often, especially in cold weather, the engine will start, but stops after a few moments. This is not unusual and, therefore, should be considered along with the normal mode of operation. The following is a description of the operational sequence when this happens. When the engine stops, the pressure in the engines' intake manifold returns to atmospheric pressure and vacuum switch 164 opens deactivating coil 146. Deactivation of coil 146 causes switch 148 to close reapplying electrical power to coil 156 and the starting sequence is repeated as previously described. Again, the throttle solenoid coil is actuated prior to applying electrical power to the starter motor 30.

START FAILURE MODE OF OPERATION

Considering first the condition where the engine starts but stops after a few moments, as described in the normal mode of operation, but continues to do so on successive start attempts. The automatic starting circuit will respond in either of the two following ways. After several successive start attempts, the intermittant application of power to heater 162 of thermal timer 160 may generate sufficient heat to cause switch 158 to open disabling relays 154 and 184 thereby preventing further energizing of the starter relay coil 24 by the automatic starting circuit. Alternatively, if the time between successive starts is sufficiently long so that switch 158 does not open, then normally open switch 116 of thermal timer 112 will close after one to three minutes and apply power to the heater of thermal timer 120. After another three to five minute period switch 124 will open removing power from relays 154 and 184. The automatic starting will shut down prior to completely draining the battery, thereby reserving for the operator sufficient power to manually start the engine.

In event, the starter motor is actuated to crank the engine but the engine does not start and no vacuum is generated in the intake manifold. Under this condition, the vacuum switch 164 does not close and relay 150 remains deactuated. Switch 148 does not open and the switch 158 of thermal timer 160 will open after a predetermined time. In the preferred embodiment, this time is between 5 to 10 seconds. When switch 158 opens, relays 154 and 180 are deactivated, thereby deactivating the starter relay 25 preventing further actuation of the starter motor.

Finally, when the starter motor 30 is actuated, but the starter does not engage the engine or otherwise is unable to crank the engine, thermal timer 160 will time out after the predetermined time and deactivate relays 154 and 184. Deactivation of relay 184 will prevent further actuation of the starter relay 25 by the automatic starting system; and disable the ignition, accessory and throttle solenoid.

Referring back to FIG. 1, an auxiliary circuit shown in dashed box 200 may be added to the automatic starting circuit previously described. The auxiliary circuit permits the automatic starting circuit to be actuated from a remote location by means of a transceiver, similar to those used for automatic garage door openers or by a thermal switch which is actuated when the engine is below a predetermined temperature. The auxiliary circuit 200 is energized by a manually actuated switch 202 having one end connected to the battery 10 through fuse 12. The other end of switch 202 is connected to a remote control receiver 204, a mode switch 206 and a normally open switch 208 of relay 210. Relay 210 has a coil 212 which closes switch 208 when coil 212 is energized. The opposite end of the mode switch is connected to a normally open thermal switch 214 monitoring the temperature of the engine. As is known in the art thermal switch 214 may monitor the temperature of the engines' oil. Thermal switch 214 will close when the temperature of the engine falls below a predetermined temperature such as −18° C. (0° F.). The output of the remote control receiver 202 and the opposite ends of switch 208 and thermal switch 214 are connected to the normally open contact of switch 104 in the automatic starting circuit. The coil 212 is connected in parallel with coil 142 of relay 140 in the automatic starting circuit having one end connected to switch 208 through normally closed switch 124 of thermal timer 120 and the other end connected to ground through the interlock switch 118.

The operation of the auxiliary circuit 200 is as follows. When the operator elects to actuate starting system by means provided for by the auxiliary circuit 200 he closes switch 202 which energizes the remote control receiver 204. If the operator further wants the engine to start if the engine's temperature falls below the predetermined temperature he also closes switch 206. Switch 206 is optional in the circuit and may be omitted by connecting switch 214 directly to switch 202. It's only function in the circuit is to deactivate thermal switch 214 while still permitting the engine to be started by the remote control receiver.

When the operator elects to start the engine from a remote location, a signal from a transmitter (not shown) activates the remote control receiver 204 which momentarily energizes coil 212 of the relay 210 closing switch 208. This latches relay 210 in the energized state and energizes the automatic starting circuit the same as if switch 104 of relay 100 had closed as previously discussed.

In a like manner, if the operator closes switch 206 and the engines temperature falls below the predetermined temperature, thermal switch 214 will close, energizing coil 212 and closing switch 208, and the engine will start as previously discussed. As the engine warms up thermal switch 214 will open but relay 210 will remain latched as long as switch 124 remains closed. After the engine has been running from about 5 to 8 minutes switch 124 will open and unlatch relay 210 removing all electricity from the system. After power is removed from thermal timer 112 and 120 they will soon return to their normal states, with switch 116 open and switch 124 closed. At some later time, the engine will cool back down to the predetermined temperature and switch 214 will reclose reinitiating the starting cycle. The cycle will repeat itself over and over until the auxiliary circuit is deactivated by the operator.

Since switch 104, the thermal switch 214 or the remote control switch of the remote control receiver 204 are in parallel, any one may be used to energize the circuit independent of the other. Further since they also only energize the automatic starting circuit, and do not control the actual starting sequence, they cannot interfere with an automatic starting sequence initiated by one of the other alternative energizing switches.

ALTERNATE EMBODIMENT

Figure 3:
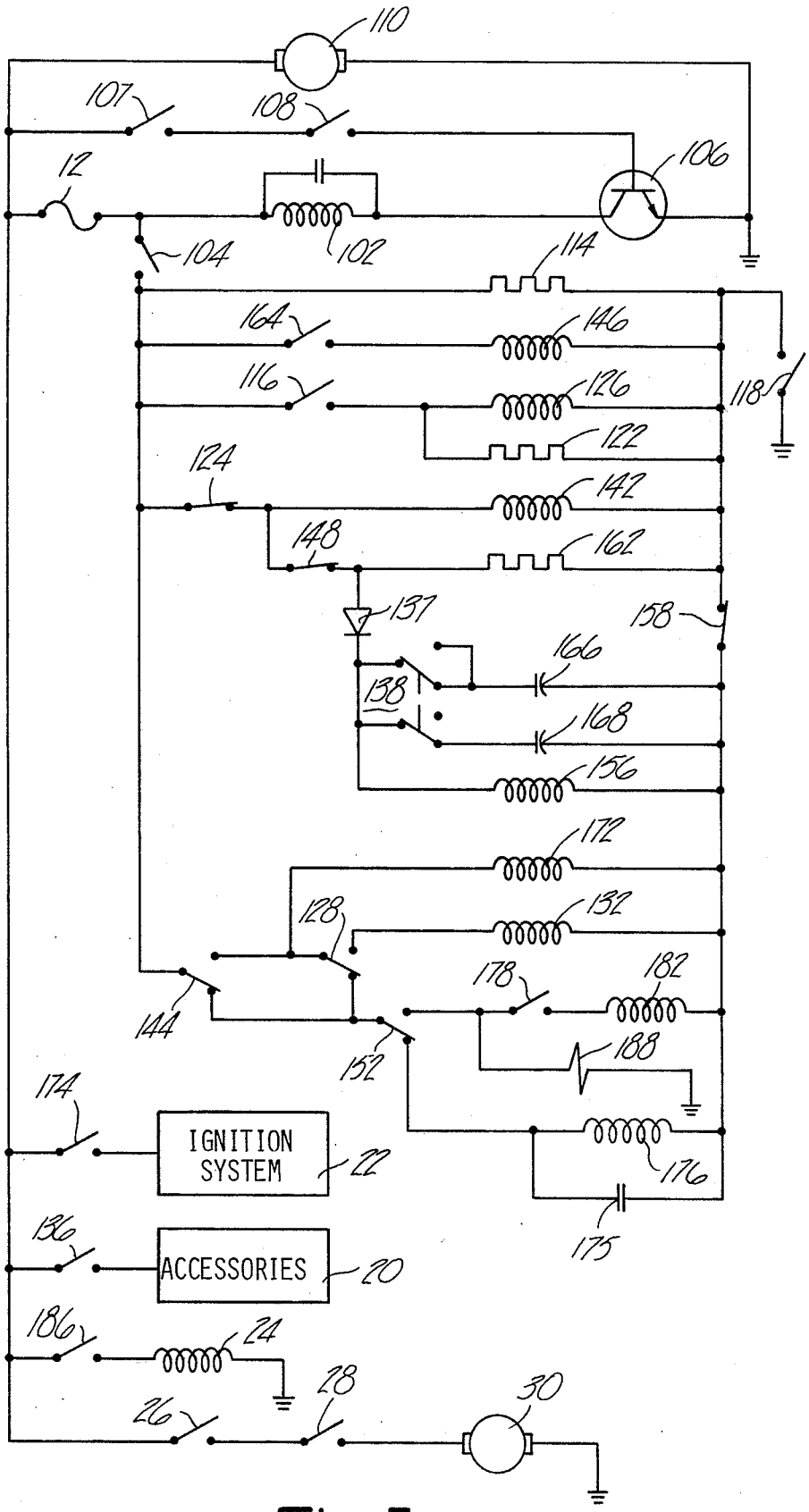
FIG. 3 is a simplified schematic of an alternate embodiment.

An alternate embodiment is shown in FIG. 3 which, like in FIG. 2, the coils and heaters are disassociated from the switches which they respectively actuate. The difference between the embodiment of circuits shown in FIGS. 2 and 3 is the connections between the switch 114, 128 and 152. In FIG. 3 switch 128 is connected between the normally open contact of switch 144 and the common pole of switch 152. As discussed with reference to FIGS. 1 and 2, when switch 104 is closed by the action of the timer 110, energizing coil 102, coils 142 and 156 are energized and switches 144 and 152 are energized and switches 144 and 152 change state. Coil 182 which actuates switch 186 to energize the starter relay 25, is now energized through the normally closed contact of switch 128. Other than this change, the automatic starting system operates the same as discussed with reference to FIGS. 1 and 2. However, if the engine has not started at the end of the first one to three minute period as determined by thermal timer 112, switch 116 will close energizing coil 126 causing switch 128 to actuate. Actuation of switch 128 will prevent further actuation of coil 182 and the starter relay 25, as well as the throttle solenoid. Thereafter, timer switch 158 opens and disables the ignition and the accessories. This alternate embodiment limits the time during which unsuccessful start attempts to one to three minutes as discussed with reference to the preferred embodiment of FIGS. 1 and 2.

It is to be noted, that vacuum switch 164 prevents the energizing of coil 182 and, therefore, prevents accidental actuation of the starter by automatic starting system if the engine had been previously started by the operator.

Having described the disclosed automatic atarting system with reference to a preferred and alternate embodiment, it is not intended that the invention be limited to the specific circuit arrangement and circuit components discussed herein. It is well known that some of the relays and thermal timers may be replaced by solid state devices and the circuit may be arranged differently to perform the same functions. Further, other switch or relays may be included in the automatic starting circuit to shut down the engine in case the engine itself has a failure like the engine exceeding in normal operating temperature, or proper oil pressure fail to develope. Appropriate switches between switch 174 and the ignition system 22 could deactivate the ignition system in event of such a failure.

Having, thus, described the invention what is claimed is:

1. An automatic starting system for an internal combustion engine having a source of electrical power having one output connected to a common ground, an ignition system, a starting interlock, a throttle for controlling the speed of the engine and an electrically actuated starter motor for cranking the engine comprising:

means for generating an activation signal;

first timer means for generating a start energize signal for a first predetermined time after the initiation of said activation signal;

an interlock switch generating an interlock signal when the starting interlock is in its actuated position;

means for generating an engine-running signal indicative that the engine has started and is running under its own power;

a throttle solenoid for moving the throttle to a start position when energized;

start signal generator means energized in response to said start energize signal, said interlock signal and the absence of said engine-running signal for generating a first signal energizing said ignition system, a second signal energizing said throttle solenoid, and a third signal energizing the starter motor to crank the engine, said start signal means generating said third signal a predetermined time after said first and second signal, and further operative to terminate said second and third signals in response to said engine running signal; and a second timer means for generating a termination signal de-energizing said start signal generator and terminating said first, second and third signals, a second predetermined time after the initiation of said start energize signal.

2. The automatic starting system of claim 1 wherein said start signal generator further includes means for delaying the termination of said second and third signals for a predetermined time after receiving said engine running signal.

3. The automatic starting system of claim 2 wherein said means for delaying includes an operator actuated selector means for changing said predetermined time.

4. The automatic starting system of claim 2 wherein said engine has electrically operated accessories associated therewith, said second timer means further includes means for generating an accessory signal a predetermined time after the initiation of said activation signal; said accessory signal energizing said accessories.

5. The automatic starting system of claim 4 wherein said first timer means is a first thermal timer having a heater and a normally closed thermally actuated switch which opens a third predetermined time after the heater is energized and wherein said normally closed thermally actuated switch receives said activation signal and outputs said start energize signal when said switch is in its normally closed state; and wherein said included means comprises:

a second thermal timer having a heater and a normally open thermally actuated switch and wherein said heater is energized by said activation signal and said normally open switch closes after a fourth predetermined time generating a delayed signal, said delayed signal energizing the heater of said first thermal timer and wherein the sum of said third and fourth predetermined times is said first predetermined time; and accessory switch means actuated by said delay signal for generating said accessory signal in response to said delay signal.

6. The automatic starting system of claim 4 wherein said start signal generator comprises:

first switch means receiving said activation signal and energized by said start energize signal to switch from a first state to a second state, said first switch outputting said activation signal at a first output terminal when said switch is in said first state and outputting said activation signal on a second output terminal when said switch is in said second state;

second switch means energized by said delayed signal to switch from a first state to a second state said second switch connecting the first and second output terminals of said first switch means when said second switch is and said first state and outputting said actuation signal on a second terminal in said second state;

third switch means receiving said start energize signal and operative to switch from a first state to said second state in response to said engine running signal, and third switch outputting said start energize signal in said first state;

fourth switch means receiving said activation signal from the second output terminal of said first switch means and energized by the start energize signal output by said third switch means to switch from a first state to a second state, said fourth switch means outputting said activation signal to a first output terminal in said first state and outputting said activation signal to a second output terminal in said second state, wherein the actuation signal output to said second output terminal in said second signal energizing said throttle solenoid;

fifth switch means receiving said activation signal from the first output terminal of said fourth switch means and energized by said activation to switch from a first state to a second state, said switch means outputting said activation signal in said first state, and fifth switch means further including means for maintaining said switch in said second state for a fifth predetermined time after said fourth switch switches to said second state;

sixth switch means receiving electrical power from said battery and energized by said activation signal output from said fifth switch means, to switch from a first state to a second state, said sixth means outputting said battery power to the electrically actuated starter motor wherein the battery power output by said sixth switch means is said third signal, and;

seventh switch means receiving electrical power from the source of electrical power and energized by the activation signal output from the second output terminal of said first switch means to switch from a first state to a second state, said seventh switch means outputting said electrical power from the source of electrical in said second state where said electrical power output by said seventh switch means is said first signal energizing said ignition system, and;

wherein said interlock signal enables the energizing of said first, second, third, fourth, sixth and seventh switch means and said termination signal disables said fourth, fifth, sixth and seventh switch means.

7. The automatic starting system of claim 6 wherein said fourth switch means further includes means for maintaining said fourth switch means in said second state for a sixth predetermined time after said third switch switches to said second state.

8. The automatic starting system of claim 6 wherein said electrically actuated starter includes a starter motor and starter relay receiving electrical power from said source of electrical power, wherein said starter relay outputs said electrical power to said starter motor when energized, the electrical power output by said six switch means in said second state energizes said starter relay.

9. The automatic starting system of claim 6 wherein said electrically actuated starter includes a starter solenoid, said third signal energizes said starter solenoid.

10. The automatic starting system of claim 6 wherein said first, second and fourth switch means are electromagnetic relays having a coil actuating a single pole double throw switch and said third, fifth, sixth and seventh switch means are relays having a coil actuating a single pole, single throw switch, said second timer means is a thermal timer having a heater connected between the output of said third switch means and said interlock switch and a normally closed thermally actuated switch operative to open at said second predetermined time after said heater is energized wherein said termination signal is generated when said thermally actuated switch opens and said thermally actuated switch is connected between the coils of said fourth, fifth, sixth and seventh and said interlock switch: and said interlock switch is a parking brake switch connected between the coils of first, second and third switch means and the thermally actuated switch of said second timer means and a common ground.

11. The automatic starting system of claim 5 wherein said accessory switch means is an electromagnetic relay having a coil actuating a normally open single pole single throw switch wherein one end of said coil receives said activation signal and the other end is connected to said interlock switch.

12. The automatic starting system of claim 1 wherein said means for generating an activation signal is a timer means generating said activation signal at a time preset by the operator.

13. The automatic starting system of claim 12 wherein said means for generating an activation signal further includes transceiver means for generating said activation signal in response to a signal generated by the operator at a remote location.

14. The automatic starting system of claim 1 wherein said means for generating an activation signal further includes a thermal switch means sensing the engine's temperature for generating said actuation signal when the engine temperature falls below a predetermined temperature.

15. An automatic starting system for the engine of an automotive vehicle, wherein said vehicle has a source of electrical power having one terminal connected to a common ground, an ignition system providing igniting fuel in predetermined timed relationship with the rotation of the engine, a parking brake, a throttle for controlling the engines speed, and an electrically actuated starter for cranking the engine; comprising:

clock means receiving electrical power from the source for generating an activation signal at a time preset by the operator;

an interlock switch operative to close providing an electrical path to the common ground when the parking brake is actuated;

first timer means connected to the common ground through said interlock switch for generating a start signal for a predetermined time in response to said activation signal when said interlock switch is closed;

first switch means connected to said ground through said interlock switch for transmitting said activation signal in response to said start signal;

a throttle solenoid for moving the throttle to a start position in response to said activation signal;

a pressure switch responsive to the pressure in the engines air intake manifold for transmitting said start signal when the pressure in the intake manifold is above a predetermined pressure indicative that the engine is not running under its own power;

second timer means energized by the start signal transmitted by said pressure switch for opening, after a predetermined time of being energized, a normally closed switch connected in series with said interlock switch second switch means connected in series with the closed switch of said second timer means and said interlock switch for transmitting power from the source to the ignition system in response to said actuation signal when the switch in said second timer means and said interlock switch are closed; and third switch means connected to said common ground through the normally closed switch of said second timer means and said interlock switch for energizing said solenoid and said starter motor in response to the start signal transmitted by said pressure switch.

16. The automatic starting system of claim 15 wherein said vehicle includes accessories to be energized a predetermined delay time after the engine has been started, said first timer means further includes a delay timer means for generating an accessory signal said predetermined delay time after receiving said activation signal.

17. The automatic starting system of claim 15 further including remotely actuated means in parallel with said clock means for generating said activation signal in response to a signal generated by the operator at a remote location.

18. The automatic starting system of claim 15 further including thermal switch means connected in parallel with said clock means, said thermal switch responsive to the engines temperature and operative to generate said activation signal when the engines temperature drops below a predetermined temperature.

* * * * *